US005768662A

United States Patent [19]

Sugihara et al.

[11] Patent Number: 5,768,662

[45] Date of Patent: Jun. 16, 1998

[54] TONER SUPPLY CARTRIDGE FOR ROTARY DEVELOPING DEVICE

[75] Inventors: Kazuyuki Sugihara, Kanagawa; Katsuhiro Kosuge, Tokyo, both of Japan

[73] Assignee: Ricoh Company, Ltd., Tokyo, Japan

[21] Appl. No.: 328,477

[22] Filed: Oct. 25, 1994

[30] Foreign Application Priority Data

Oct. 25, 1993 [JP] Japan ..... 5-266660
Nov. 26, 1993 [JP] Japan ..... 5-296658

[51] Int. Cl.[6] ..... G03G 15/08

[52] U.S. Cl. ..... 399/119; 399/258

[58] Field of Search ..... 355/260, 327; 399/110, 111, 112, 119, 222, 223, 258

[56] References Cited

U.S. PATENT DOCUMENTS

| | | | |
|---|---|---|---|
| 4,743,938 | 5/1988 | Ohno | 355/327 |
| 4,782,360 | 11/1988 | Iwamoto et al. | 355/4 |
| 4,792,825 | 12/1988 | Saito et al. | 355/300 |
| 5,030,997 | 7/1991 | Michlin et al. | 355/260 |
| 5,258,819 | 11/1993 | Kimura et al. | 355/326 R |
| 5,331,390 | 7/1994 | Kimura et al. | 355/327 X |

FOREIGN PATENT DOCUMENTS

| | | |
|---|---|---|
| 62-109074 | 5/1987 | Japan . |
| 62-163071 | 7/1987 | Japan . |
| 62-163072 | 7/1987 | Japan . |
| 62-163073 | 7/1987 | Japan . |
| 63-78169 | 4/1988 | Japan . |
| 63-78170 | 4/1988 | Japan . |
| 63-78171 | 4/1988 | Japan . |
| 63-78172 | 4/1988 | Japan . |
| 63-78173 | 4/1988 | Japan . |
| 5-241417 | 9/1993 | Japan . |

*Primary Examiner*—Fred L. Braun
*Attorney, Agent, or Firm*—Woodcock Washburn Kurtz Mackiewicz & Norris LLP

[57] ABSTRACT

A toner cartridge for a rotary developing device according to the current invention maximizes the storage capacity while it minimizes clogging or aggregation of stored toner. The toner cartridge is placed on an outer side surface of the rotary developing device and rotates around with the rotary developing device around the same axis of rotation. During the rotation, the stored toner is shaken and thrown against an internally projected dispersing portion in the cartridge for minimizing the aggregation of the toner. In addition, a vibration mechanism based upon the same rotational movement further minimizes the aggregation. The toner cartridges each containing a unique color such as cyan, magenta, yellow and black may be placed together to form a ring on the outer side surface. These toner cartridges are identical and maximize the storage capacity by substantially eliminating unused space between any adjacently placed cartridges.

26 Claims, 8 Drawing Sheets

TONER SUPPLY CARTRIDGE FOR ROTARY DEVELOPING DEVICE

FIELD OF THE INVENTION

The current invention relates to toner supply cartridges for image reproduction systems and, more particularly, relates to the high-capacity toner supply cartridge associated with the rotary developing apparatus used in copiers, printers and the like.

BACKGROUND OF THE INVENTION

In general, an image reproduction apparatus reproduce images on an image-carrying medium by transferring toner or developer to the medium in relation to a given image. Such transfer is typically achieved through the use of a developing unit which places toner or developer on the image-carrying medium via a photoreceptor drum. To accomplish image transfer, the photoreceptor drum surface is first prepared by an electrophotographic image process to selectively accept toner in relation to the image. The developing unit then applies toner onto the photoreceptor drum via a developing roller. Toner representing the desired image on the photoreceptor drum is transferred onto an image-carrying medium such as paper. Further processing of the paper, for example, the application of heat, serves to permanently adhere the toner to the paper.

In recent years, rotary developing apparatus having multiple developing units have been proposed for color copiers, color printers and other image-forming apparatus as disclosed, for example, in U.S. Pat. Nos. 4,782,360, 4,792,825, 5,258,819. In general, multiple independent developing units are housed in the rotary developing apparatus. Each of the multiple developing units are positioned around a cylindrical housing of the rotary developing apparatus and independently applies toner of a different color to a photoreceptor drum. To apply toner, only one independent developing unit is juxtaposed to the photoreceptor drum at a given time. Thus, for example, if four colors such as yellow, magenta, cyan and black are used, a developing unit containing one of these colors is rotatably positioned to juxtapose the photoreceptor drum to apply toner of the particular color according to a desired image.

The above patents suggest that a separate toner cartridge for each desired color be placed within the same developing unit. Although this type of construction allows relatively easy transportation of toner to the developing unit, the total size of the rotary developing apparatus is undesirably large. The large rotary developing apparatus is especially disadvantageous for a portable or compact image-forming apparatus.

To reduce the overall size of the rotary developing apparatus, prior art toner cartridges 12 have been placed outside a cylindrical housing 10, as shown in FIG. 1. Since the size of the toner cartridge is substantial with respect to other parts of the developing unit, a significant space reduction is achieved. In addition, the capacity and shape of the externally placed toner cartridge is independent of the rotary developing apparatus.

FIG. 2 shows conventional wedge-shaped external toner cartridges 14 and photoreceptor drum 6. The shape and the capacity of toner cartridges 14 can be changed without modifying the developing apparatus housing 10. However, external toner cartridges require an additional transfer mechanism. Since toner is placed outside the developing apparatus housing, and since the developing units are positioned within the housing, the toner must be transferred from an external cartridge to a corresponding developing unit via a transfer mechanism.

FIG. 3 shows a conventional toner transfer mechanism having a transport screw 18 inside toner supply conduit 20 both extending from the inside of toner cartridge 22 to corresponding developing unit 24 in a photoreceptor drum. Each toner cartridge includes its own supply roller or agitator 23 to agitate and move the toner in its chamber. Toner cartridge 22 feeds toner onto screw 18 through opening 43. Toner is thereafter pushed forward by the threads of the rotating screw 18 towards developing unit 24.

Despite these developments, conventional external toner cartridges in the above-cited references still have several undesirable features. For example, before toner is transported to the developing unit via the transfer mechanism, if the toner is left in the toner cartridge for a long time, fine powder or particles of toner tend to aggregate. Aggregation decreases mobility of toner in the supply cartridge. Thus, the aggregated toner often fails to move towards a dispensing portion and remains unused. In certain situations, the aggregated toner sticks to an inside wall of the toner cartridge resulting in a failure to supply necessary toner to the developing unit. Another undesirable feature is the structural stability of the external cartridge with respect to the rotary developing apparatus. Since the developing apparatus is rotated to a predetermined position for different colors, the external toner cartridge must be pivotally secured to the revolving rotary developing apparatus. In improving these undesirable features, the capacity of the toner cartridge should not be sacrificed to prevent frequent toner cartridge changes.

SUMMARY OF THE INVENTION

To solve the above problems, an apparatus according to one preferred embodiment of the current invention discloses a toner cartridge for an image reproduction system which includes a holding portion located at one end of the toner cartridge for storing toner; a dispensing portion located at another end of the toner cartridge, the dispensing portion having an opening, wherein toner is dispensed through the opening; and a dispersing portion located between the holding portion and the dispensing portion having a projection for dispersing the toner as the toner moves between the holding portion and the dispensing portion.

According to a second aspect of the current invention, a toner cartridge including a holding portion located at a top portion of the toner cartridge for storing toner and a dispensing portion located at a bottom portion of the toner cartridge for dispensing the toner through an opening, the improvement includes a dispersing portion located between the holding portion and the dispensing portion having a projection for dispersing the toner as the toner moves between the holding portion and the dispensing portion; and a dispersing member positioned in the toner cartridge, the dispersing member freely moving within the toner cartridge for further dispersing the toner.

According to a third aspect of the current invention, a toner cartridge system for image reproduction includes a developing unit for developing an image using toner; a toner cartridge mounted to the exterior of the developing unit, the toner cartridge comprising a holding portion located at one end of the toner cartridge for storing the toner, a dispensing portion located at the other end of the toner cartridge, the dispensing portion having an opening, wherein the toner is dispensed through the opening, and a dispersing portion located between the holding portion and the dispensing portion for dispersing the toner before dispensing as toner moves between the dispensing portion and the holding portion; and a toner transportation mechanism in fluid communication with the opening of the dispensing portion for transporting toner passing through the opening to the developing unit.

According to a fourth aspect of the current invention, a toner cartridge system for an image reproduction apparatus includes a rotary developing device including a plurality of independent developing units, each of the developing units developing a part of an image using a unique color toner, wherein the plurality of independent developing units is rotatably positioned one at a time for use at a developing position; and a toner supply cartridge connected to each of the independent developing units for supplying the unique color toner, the toner supply cartridge having a dispersing portion having a projection inside the toner supply cartridge for dispersing the toner as the toner supply cartridge is simultaneously rotated with the independent developing unit around the same axis.

According to a fifth aspect of the current invention, a toner cartridge system for image reproduction includes rotary developing means including a plurality of independent developing units, each of the independent developing units developing a part of an image using a unique color toner, wherein the plurality of the developing units is rotatably positioned one at a time at a developing position; toner supply means located outside the rotary developing means for supplying the unique color toner, the toner supply means including a holding portion located at one end of the toner supply means for storing the toner, a dispensing portion located at the other end of the toner supply means, the dispensing portion having an opening, wherein the toner is dispensed through the opening, the opening being optimally positioned for dispensing at the developing position, and a dispersing portion located between the holding portion and the dispensing portion having a projection for dispersing the toner as the toner moves between the dispensing portion and the holding portion; and toner transportation means in fluid communication with the opening for transporting the toner from the opening to the independent developing unit.

According to a sixth aspect of the current invention, a toner cartridge supplying system for image reproduction includes a developing unit for developing an image using toner, the developing unit having a side surface; a plurality of toner hoppers located on the side surface for collecting the toner, the toner hoppers being positioned at equal intervals on the side surface; and a plurality of toner cartridges, wherein each of the toner cartridges is attached to a first one of the hoppers, each of the toner cartridges contacting at least a second one of the hoppers.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENTS

Figure 4:
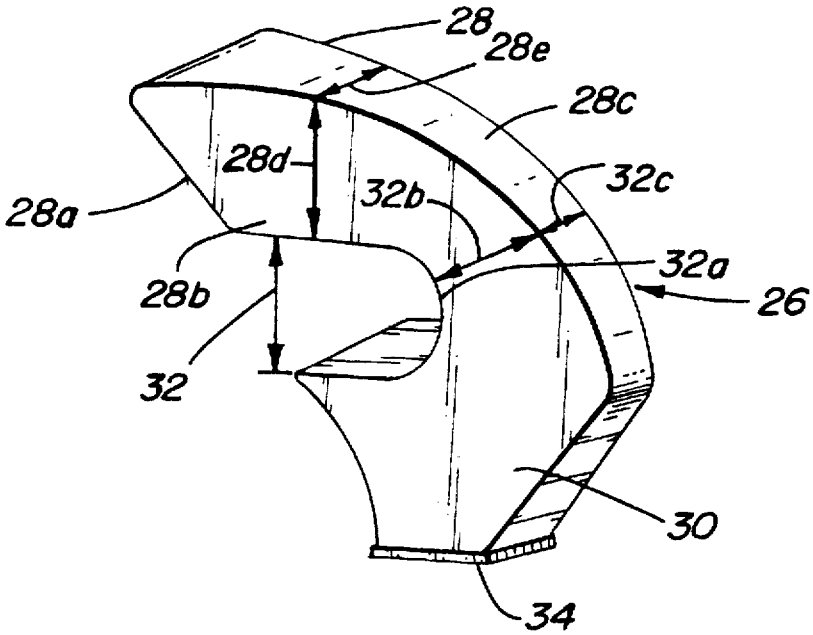
FIG. 4 shows a perspective view of a preferred embodiment of the toner cartridge according to the current invention.

Referring now to the drawings, wherein like reference numerals designate corresponding structure throughout the views, and referring in particular to FIG. 4, a preferred embodiment of a toner cartridge or toner supply cartridge 26 according to the current invention is disclosed. Cartridge 26 is shown to include a storage or holding portion 28, a dispensing portion 30 and a dispersing portion 32. Holding portion 28 has an inner holding portion height **28*d* and an inner holding portion width 28*e* and is mainly provided for storing toner. A top wall 28*c* is curved. Dispensing portion 30 includes a bottom opening 34. Oppositely located side walls have a funnel shape which tapers towards opening 34. Between storage portion 28 and dispensing portion 30, a dispersing portion 32 has an inner dispersing portion height 32*b* and inner dispersing portion width 32*c* and is provided with an inward projection. Although the inward projection provides gentle circular tip 32*a* in this preferred embodiment, tip 32*a*** can be modified to be a more acute angle.

Still referring to FIG. 4, toner in toner cartridge 26 tends to move towards opening 34 due to gravity when toner cartridge 26 is vertically positioned. To enhance toner movement towards opening 34, side wall 28*a* and bottom wall 28*b* of top storage portion 28 are inclined towards opening 34. In addition, toner cartridge 26 is made of plastic or other suitable material that provides substantially smooth inner surfaces to prevent toner from sticking to the surfaces.

Figure 5:
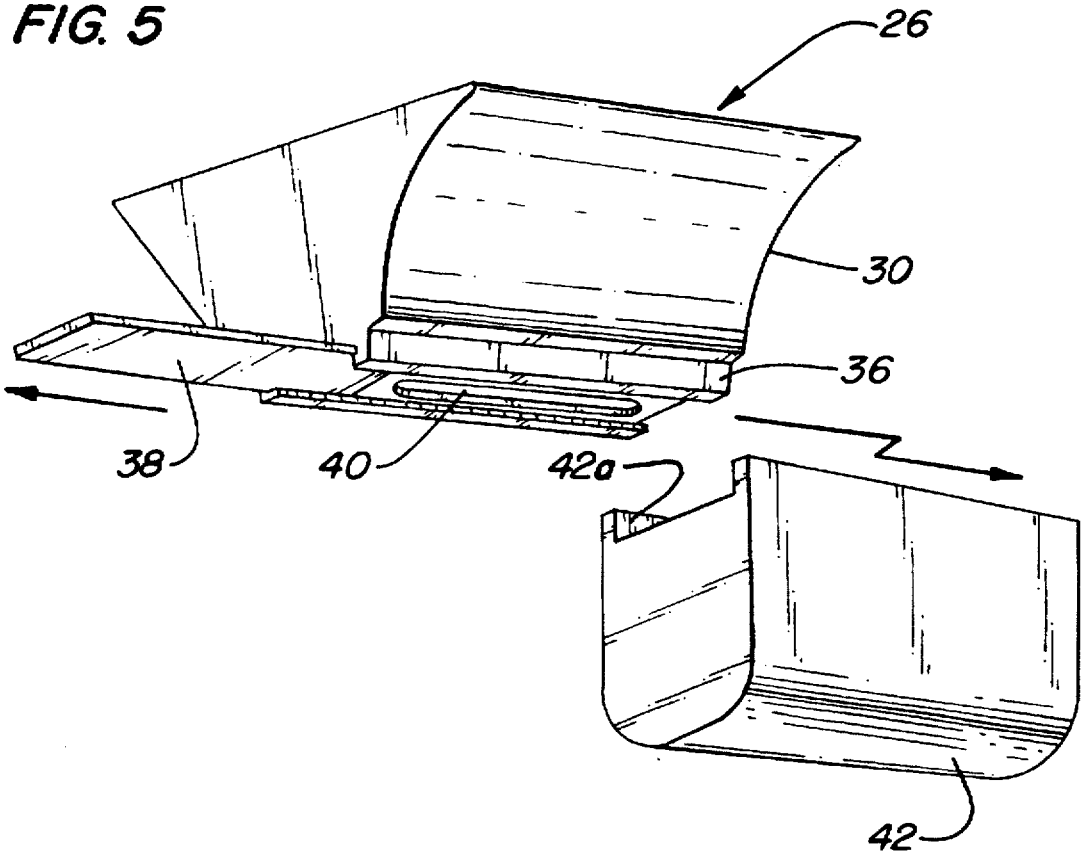
FIG. 5 shows a perspective view of a bottom portion of the preferred embodiment of the toner cartridge as shown in FIG. 4 along with a part of a toner transfer mechanism.

Referring to FIG. 5, to install toner cartridge 26 on a side wall of a rotary developing apparatus, a bottom portion of toner cartridge 26 is placed over a top portion of a toner supply unit or hopper 42. During installation a slide shutter 38 of toner cartridge 26 slides along pair of guides 36 to expose opening 40. While slide shutter 38 slides to expose opening 40, the outer edge of guides 36 also slides along inner edge 42*a* of toner supply unit 42. Thus, during installation, toner can be poured into toner supply unit 42 and is prevented from spilling outside.

Figure 6:
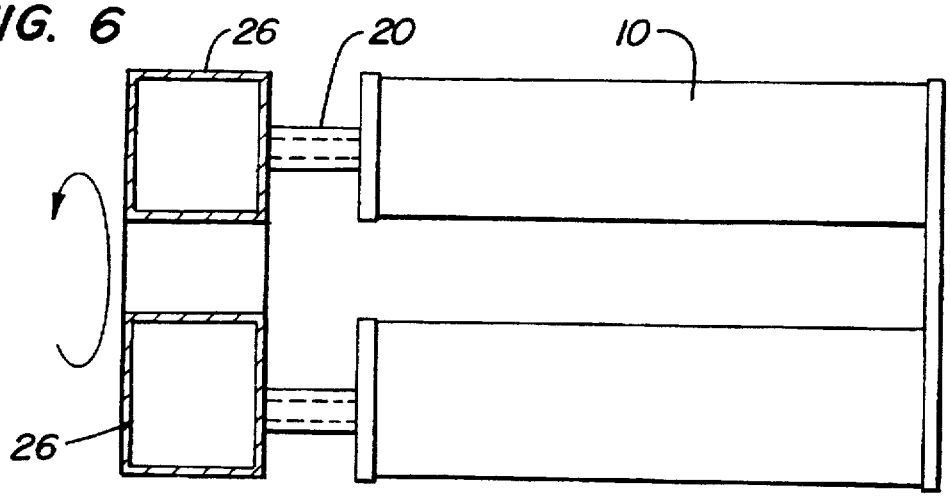
FIG. 6 shows an overhead view of the relative position of the toner cartridge with respect to the rotary developing apparatus.

Referring to FIG. 6, at least two installed toner cartridges 26 are shown with rotary developing apparatus 10. Toner cartridges 26 are mounted outside rotary developing apparatus 10 and are respectively connected to a corresponding developing unit (not shown) in rotary developing apparatus 10 via toner supply conduits 20. As indicated by an arrow, toner cartridges 26 simultaneously rotate around the same axis as rotary developing apparatus 10.

Figure 7:
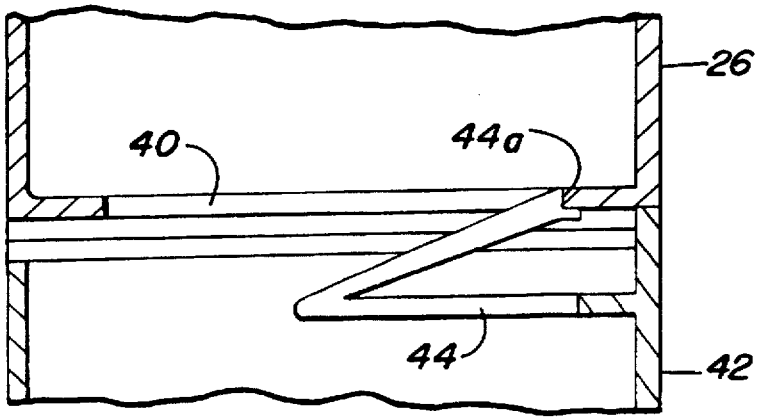
FIG. 7 shows a cross-sectional view of the toner cartridge in a latched position with respect to the toner transfer mechanism.

Referring to FIG. 7, latch 44 inside toner supply unit 42 locks installed toner cartridge 26 by engaging hook portion 44*a* of the cartridge. This latch mechanism assures that toner cartridge 26 and the rotary developing apparatus will rotate around the same axis without detaching from toner supply unit 42.

Figure 8:
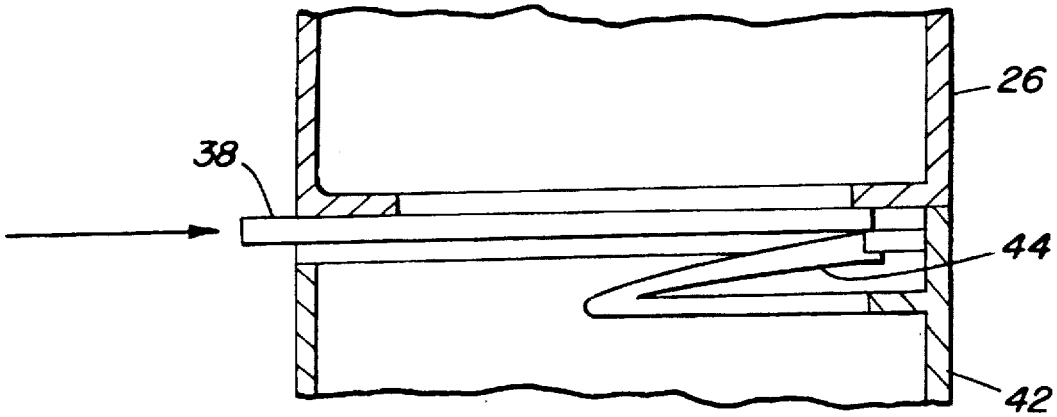
FIG. 8 shows a cross-sectional view of the toner cartridge in a unlatched position with respect to the toner transfer mechanism.

Referring to FIG. 8, to remove installed toner cartridge 26 from toner supply unit 42, slide shutter 38 is inserted between toner cartridge 26 and toner supply unit 42. As slide shutter 38 presses against locking latch 44, hook portion 44*a* is disengaged from cartridge 26 to allow toner cartridge 26 to slide on toner supply unit 42. As slide shutter 38 disengages latch 44, opening 40 is closed. Thus, toner cartridge 26 can be removed from toner supply unit 42 without spilling remaining toner.

Figure 9:
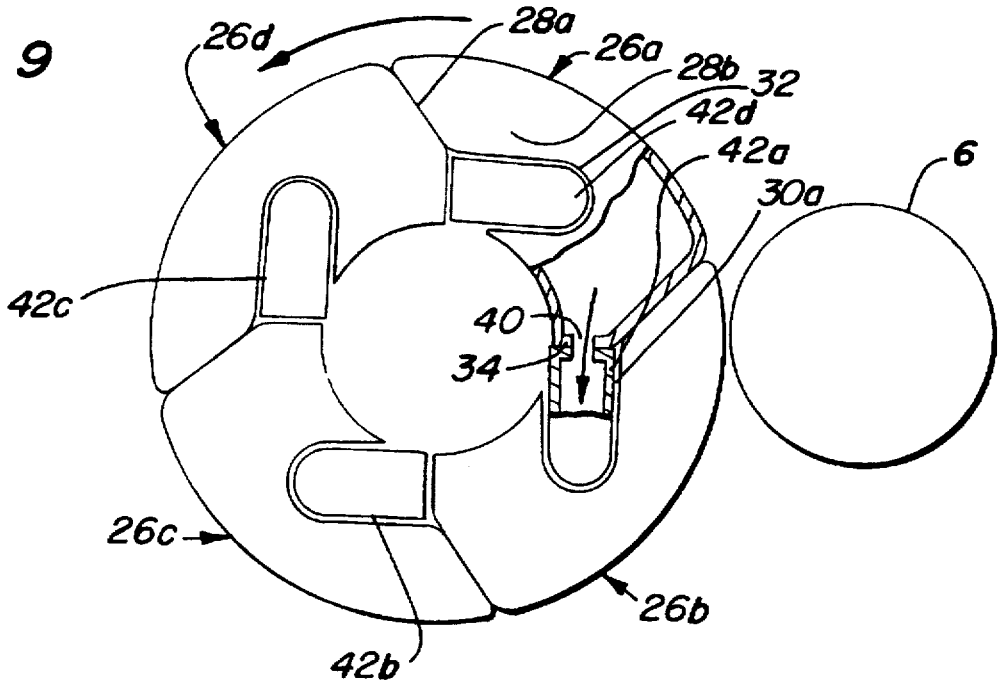
FIG. 9 shows a side view of four toner cartridges externally placed on the side of the rotary developing apparatus.

FIG. 9 is a side view of installed toner cartridges 26*a*–26*d* and toner supplying units 42*a*–42*d* as well as photoreceptor drum 6. The four identically shaped toner cartridges 26*a*–26*d* may contain toner of any colors such as cyan, magenta, yellow and black for color image production. These toner cartridges are easily removable as described above and may be disposable. By contrast, toner supplying units or hoppers 42*a*–42*d*, respectively located in each quadrant, are not removed or replaced during installation or removal of toner cartridges 26. However, according to another embodiment, the toner supplying units can be removable, and their number and positions may be varied.

Still referring to FIG. 9, four substantially wedge shaped toner cartridges 26*a*–26*d* are arranged in a ring or a doughnut shape. In general, each toner cartridge 26 is connected to one corresponding toner supply unit 42, while the same toner cartridge surrounds a second adjacent toner supply unit without connecting thereto. For example, according to a preferred embodiment, opening 40 of toner cartridge 26*a* is connected to toner supply unit 42*a* while an outer surface of toner cartridge 26*a* in dispersing portion 32 surrounds adjacent toner supply unit 42*d*. The circular geometric configuration of the toner cartridges 26*a*–26*d* substantially eliminates any unused space between any two adjacent toner cartridges thereby maximizing toner storage capacity.

The above-described geometric configuration as shown in FIG. 9 also allows each toner cartridge to squarely contact two adjacent toner cartridges as well as two toner supply units. For example, toner cartridge 26*a* contacts left adjacent toner cartridge 26*d* at side wall 28*a* as well as at dispensing portion wall 30*a*. In addition, bottom wall 28*b* of toner cartridge 26*a* also contacts toner supply unit 42*d* while the bottom wall 34 of dispensing portion 30 is secured to toner supply unit 42*a*. Because of these above-described contacts, each toner cartridge 26 is structurally supported during the rotational movements of rotary developing apparatus 10.

FIG. 9 also shows that toner cartridge 26*a* is vertically held at a developing position and connected to toner supply unit 42*a* closest to photoreceptor drum 6. In this position, toner cartridge 26*a* is vertically held so that the top storage portion is above the dispensing portion. In this position, toner supply unit 42*a* is directly below the dispensing portion of toner cartridge 26*a* creating a gravitationally optimal angle for dispensing toner from the funnel-shaped dispensing portion into toner supply unit 42*a* through opening 40. Toner from the toner cartridge at the developing position is applied to photoreceptor drum 6 as will be later described. The rotary developing apparatus will preferably rotate in a counter-clockwise direction so as to position another toner cartridge for applying a different toner to photoreceptor drum 6.

Figure 10:
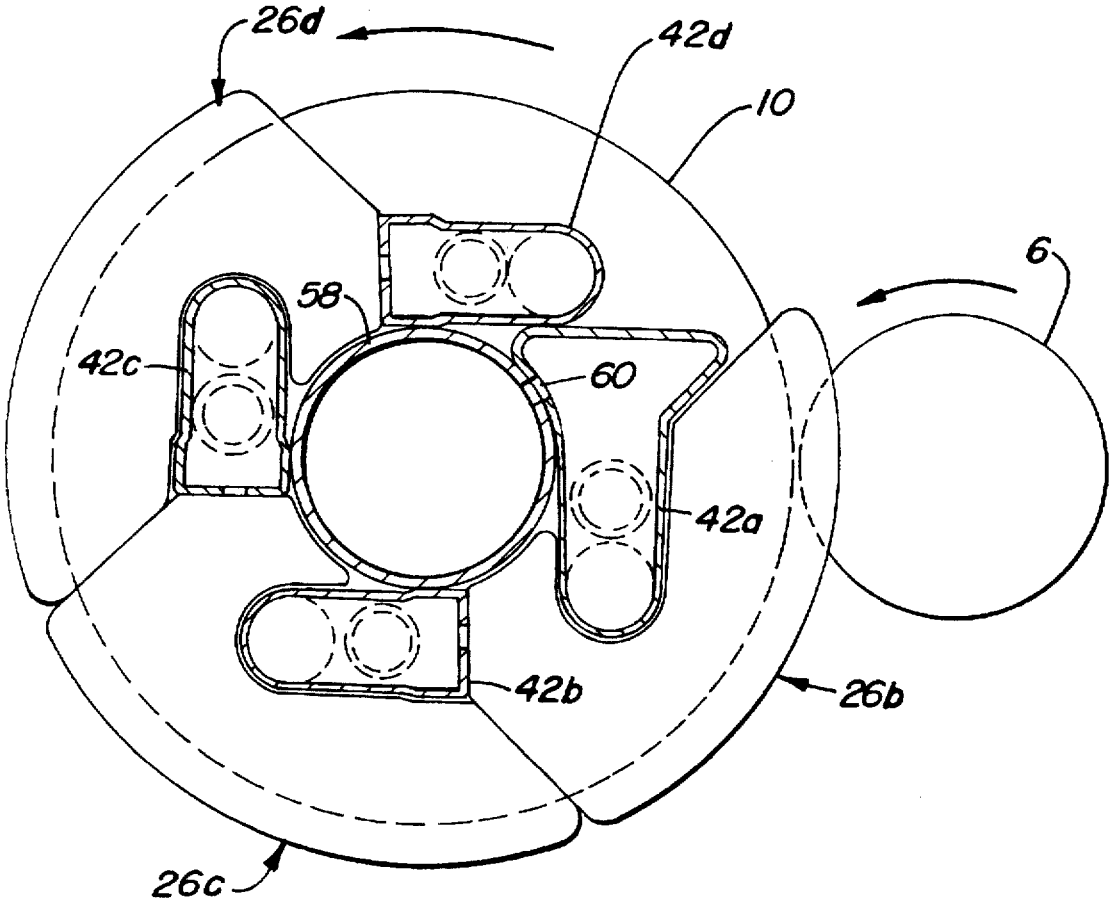
FIG. 10 shows a side view of three toner cartridges externally placed on the side of the rotary developing apparatus.
Figure 11:
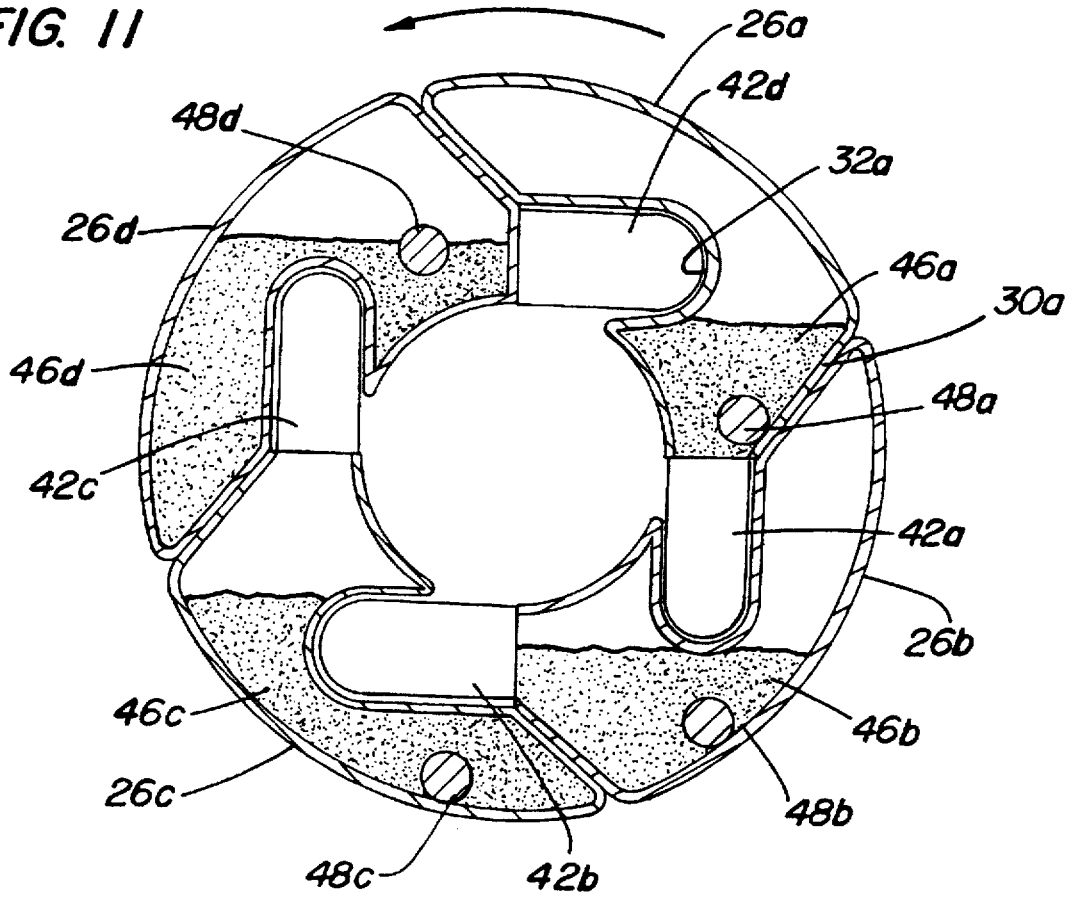
FIG. 11 shows a transparent view of the four external toner cartridges each with a dispersing member and toner at respective positions.

Now referring to FIG. 10, as an alternative embodiment, three toner cartridges 26*b*–26*d* are installed on side wall of rotary developing apparatus 10. Toner supply unit 42*a* is not used by this three-color configuration. However, as will be described later, toner supply unit 42*a* may be used for an additional cylindrical toner supply cartridge. Three toner cartridges 26*b*–26*d* are larger in storage capacity than those shown in FIG. 9 as toner cartridges partially extend beyond the diameter of rotary developing housing 10. FIG. 11 is a cross-sectional view of installed toner cartridges 26*a*–26*d* respectively containing toner 46*a*–46*d*. As rotary developing apparatus 10 is rotated, each one of toner cartridges 26*a*–26*d* is positioned in four different quadrants. As depicted, toner cartridge 26*a* is in the vertical developing position described above as the optimal dispensing angle. In this position, toner 46*a* will be funneled towards the dispensing portion 30*a* and toner supply unit 42*a*. Although depending upon the amount of the toner left in a toner cartridge, toner in a toner cartridge at the developing position occupies mainly the dispensing portion.

Still referring to FIG. 11, toner 46*d* in toner cartridge 26*d* occupies a substantial part of the storage portion and a part of the dispensing portion. Toner 46*c* in toner cartridge 26*c* occupies mostly the storage portion and some of an adjacent transitional portion. Toner 46*b* of toner cartridge 26*b* occupies some transitional portion as well as the dispensing portion. Thus, as the toner cartridge is rotated, the toner moves around and occupies different portions of the toner cartridge.

The above-described internal movement of the toner within the toner cartridge prevents the aggregation of toner. According to a preferred embodiment of the current invention, as shown in FIG. 11, when the toner moves from upper right quadrant 46*a* to upper left quadrant 46*d*, dispersing portion 32*a* disperses the toner by dividing into two portions. The continual shift of the toner around the dispersing portion also prevents the aggregation of the toner.

Again referring to FIG. 11, in addition to dispersing portion 32, according to one preferred embodiment, the toner cartridge also includes dispersing members 48*a*–48*d* which promote the prevention of toner aggregation. Although dispensing members 48*a*–48*d* are not required to practice certain aspects of the current invention, as the toner cartridge is rotated counter-clockwise, dispersion members 48a–48d move to different parts of the toner cartridge. For example, in general, dispersion member 46a is positioned at the bottom of dispensing portion 30 in the upper right quadrant and moves away from the dispensing portion towards storage portion 28 as the toner cartridge is rotated counter clockwise towards the lower left quadrant, in toner cartridges 26d and 26c. When the toner cartridge is rotated to the lower right quadrant, dispersing member 48b moves towards the dispensing portion. Thus, the movement of the dispersing member assists in the continuous mixing of the toner.

Figure 12A:
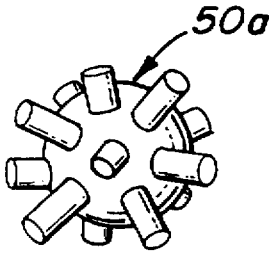
FIG. 12A and 12B show different embodiments of the dispersing member.
Figure 12B:
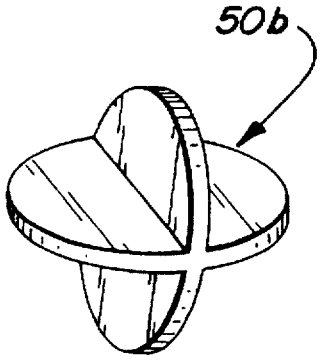

Referring to FIGS. 12A and 12B, above-described dispersing members 48 include different embodiments such as spiny sphere 50a, two circular plates 50b and the like. These and other variations of the dispersing member may be manufactured from plastic, metal, rubber and other suitable materials with various dimensions. Although there is no known limitation as to the shape of the dispersing member, the size of the dispersing member should be larger in diameter than the width of opening 40 of toner cartridge 26 so as to prevent egress of the dispensing member from the toner cartridge. In addition, the size of the dispersing member should be also less than the cross-sectional area across the dispersing portion to allow the movement of the dispensing member between the holding portion and the dispensing portion.

Figure 13:
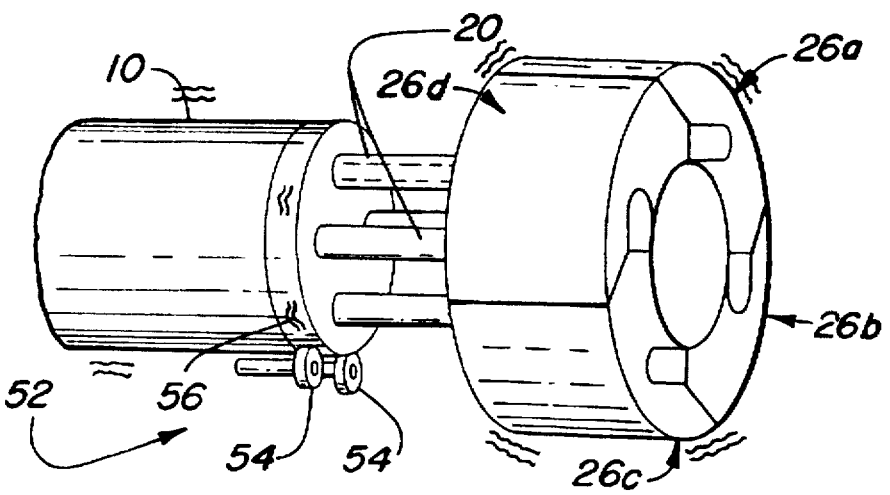
FIG. 13 shows a perspective view of a vibrating mechanism for vibrating the external cartridges and the rotary developing apparatus.

Referring to FIG. 13, according to a yet another embodiment, vibration mechanism 52 applies vibration forces to the rotary developing apparatus housing 10 as well as toner cartridges 26a–26d as an additional means to prevent the aggregation of toner. Vibration mechanism 52 includes multiple projections 56 located on the outer housing surface of rotary developing apparatus 10 and at least a pair of fixed rollers 54. As rotary developing apparatus 10 rotates, projections 56 ride over the fixed rollers so as to cause an intermittent vibration force against developing apparatus 10. The same vibration force is conveyed to the toner cartridges through the toner supply conduits 20, further preventing the aggregation of the toner.

Figure 14:
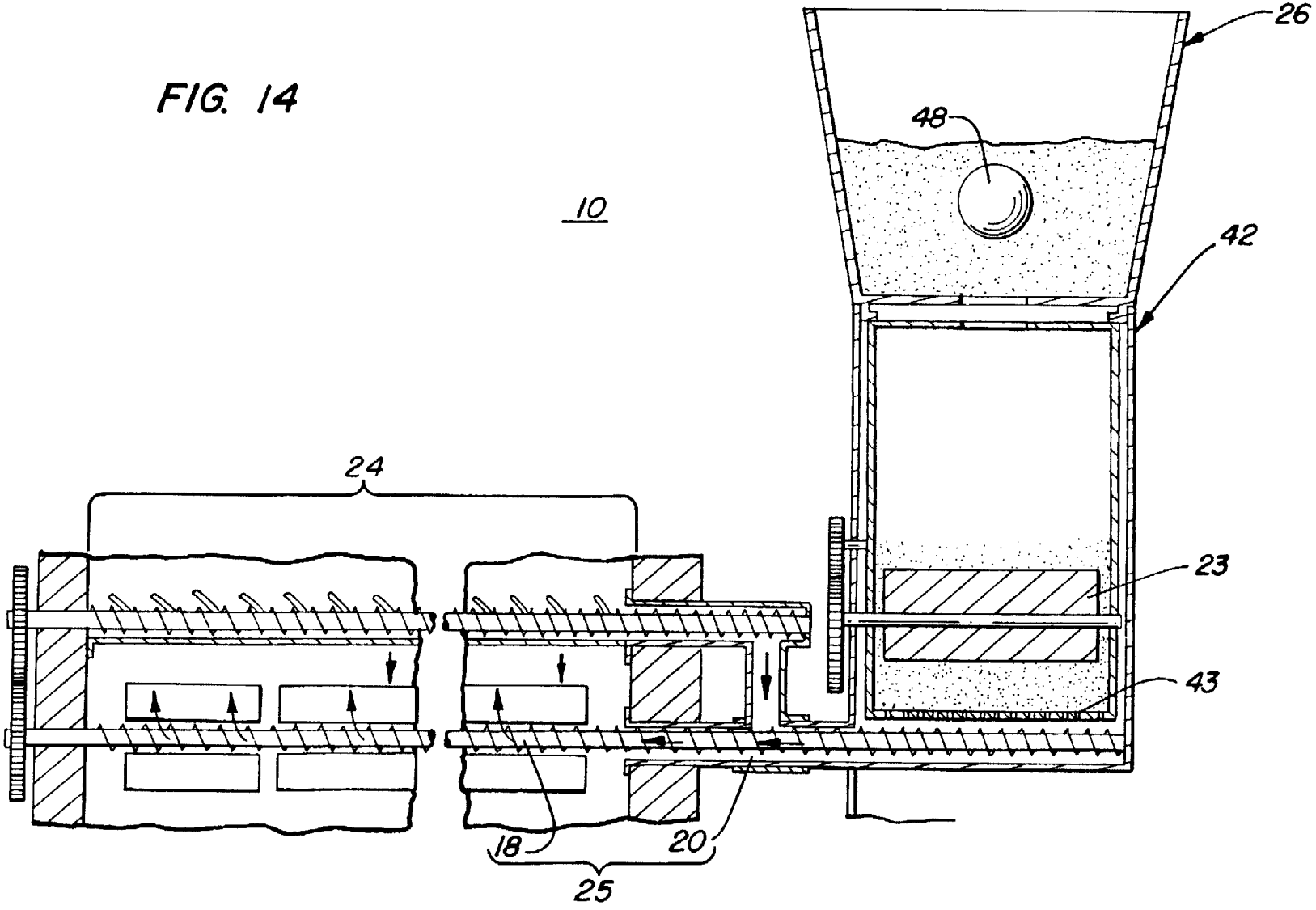
FIG. 14 shows a cross-sectional view of a toner transfer mechanism with a preferred embodiment of the toner cartridge.

Referring to FIG. 14, toner transfer mechanism 25 in general includes toner supply unit 42 and toner conveyer 25. Toner conveyor 25 includes transport screw 18 and toner supply conduit 20, both extending from inside toner supply unit 42 to corresponding developing unit 24. The screw is placed inside the toner supply conduit 20, and a toner supply unit or hopper 42 feeds toner onto screw 18 through opening 43. Toner is pushed forward by the threads of rotating screw 18 towards developing unit 24.

Figure 1:
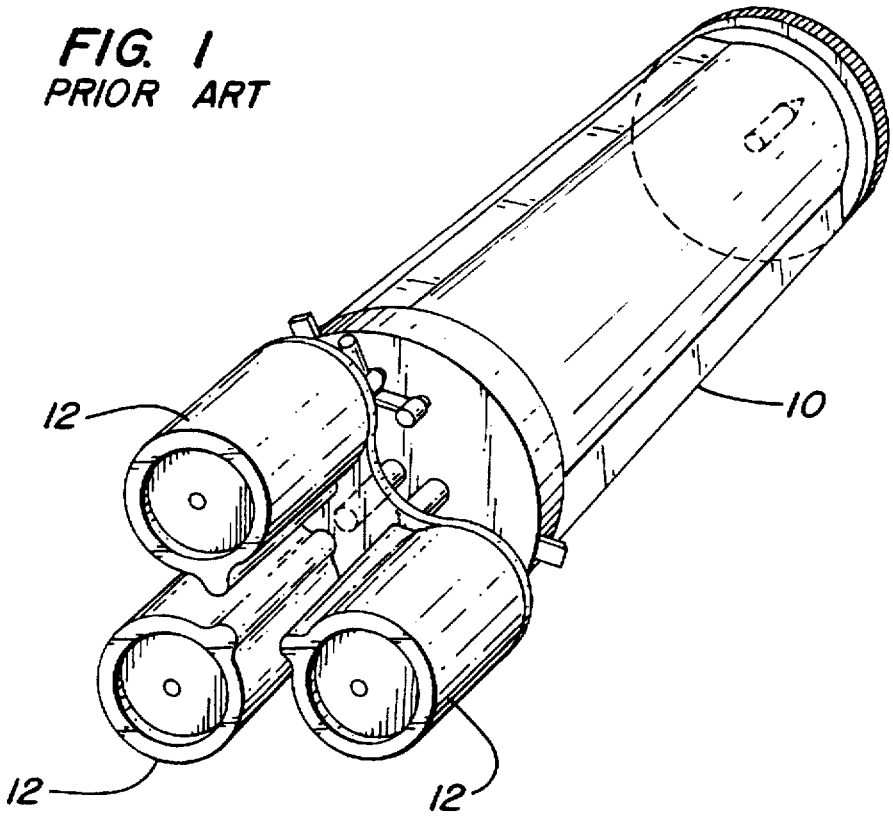
FIG. 1 PRIOR ART
FIG. 1 shows a perspective view of externally placed toner cartridges for a rotary developing apparatus in the prior art.
Figure 2:
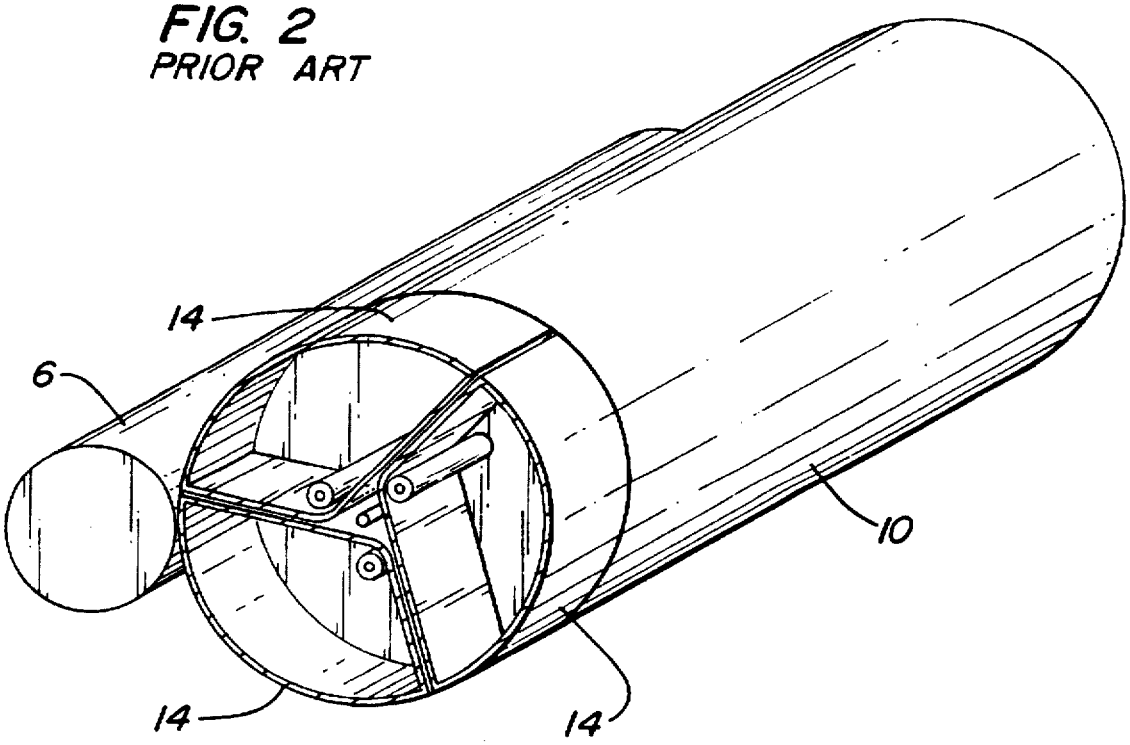
FIG. 2 PRIOR ART
FIG. 2 shows another example of external toner cartridges for a rotary developing apparatus in the prior art.
Figure 3:
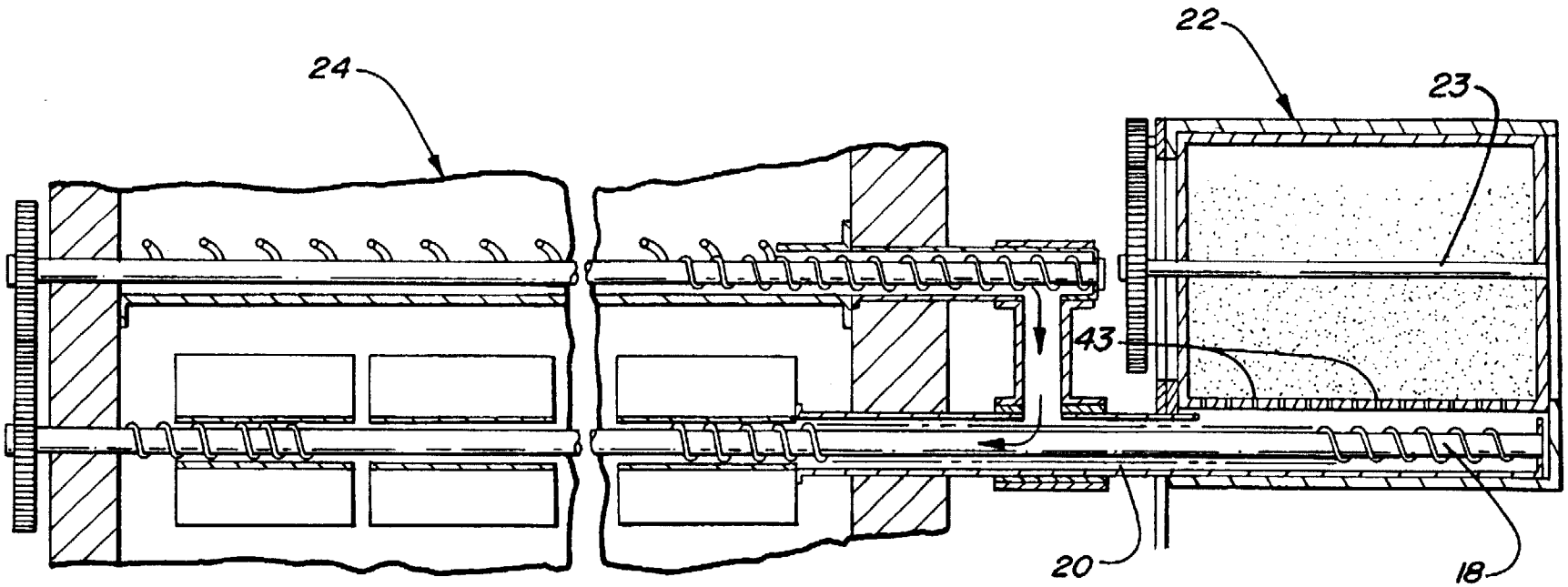
FIG. 3 PRIOR ART
FIG. 3 illustrates a cross-sectional view of a toner transfer mechanism of the prior art rotary developing apparatus.

In contrast to a prior toner cartridge 22 which includes supply roller 23 within its chamber as shown in FIG. 3, toner cartridge 26 according to the current invention does not include any roller. Supply roller or agitator 23 according to the current invention is placed in supply unit 42. As described above, according to one preferred embodiment, when toner is depleted, the empty toner cartridge may be disposed and replaced with a new toner cartridge. Since each toner cartridge 26 according to a preferred embodiment does not contain roller, but rather, contains an inexpensive dispersing member 48, the manufacturing cost of toner cartridge 26 is reduced without sacrificing its toner agitation capability.

Figure 15:
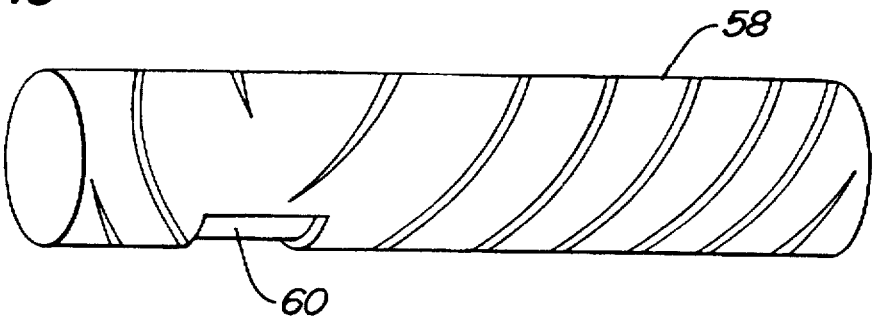
FIG. 15 shows a perspective view of a high capacity cylindrical toner cartridge for use with a preferred embodiment of the current invention.
Figure 16:
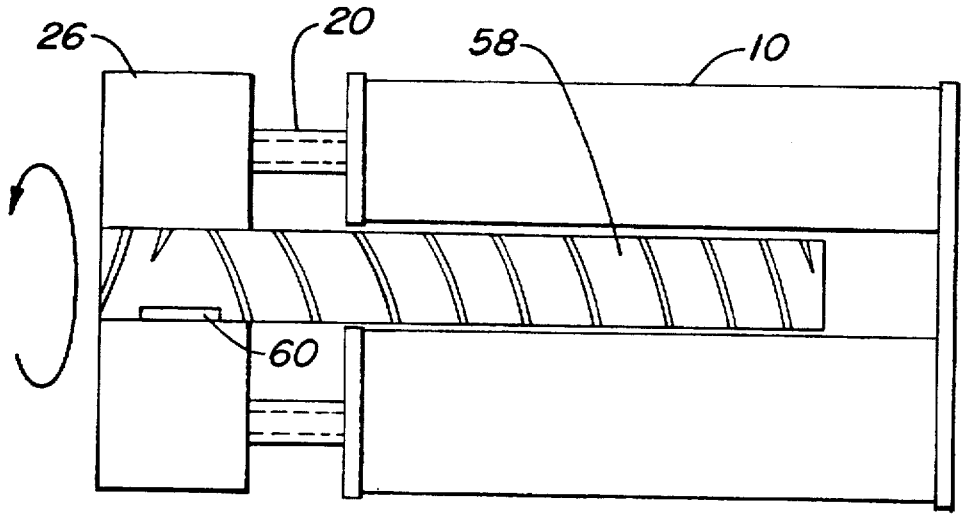
FIG. 16 shows a cross sectional view of the rotary developing apparatus and the high capacity cylindrical toner cartridge along with the external toner cartridge.

Referring to FIGS. 15 and 16, another embodiment of a toner cartridge is shown. A cylindrical toner cartridge 58 is used in conjunction with toner cartridge 26 forming a doughnut shape. As shown in FIG. 16, cylindrical toner cartridge 58 is placed in the center of the ring-like arrangement of cartridges 26 and extends into rotary developing apparatus 10. Cylindrical toner cartridge 58 utilizes an otherwise dead space in rotary developing apparatus 10 and provides a high-capacity storage space for a high-demand toner such as black toner. In contrast to toner movement in toner cartridge 26, the toner in cylindrical toner cartridge 58 first moves towards toner cartridges 26. When toner reaches predetermined toner supply unit 42a through opening 60 as shown in FIG. 10, the toner is transferred back towards corresponding developing unit 24 via transfer mechanism 25. Although not shown, cylindrical toner cartridge 58 may have a dispersing portion within its chamber.

It is to be understood, however, that even though numerous characteristics and advantages of the present invention have been set forth in the foregoing description, together with details of the structure and function of the invention, particularly with respect to Ricoh copier product line AZALEA, models A166-60, A166-01, A166-02, and A166-03, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A toner cartridge for an image reproduction system, said cartridge comprising:

a holding portion located at one end of the toner cartridge for storing toner;

a dispensing portion located at another end of the toner cartridge, said dispensing portion having an opening, wherein toner is dispensed through said opening; and a dispersing portion located between said holding portion and said dispensing portion having an inward curved projection for dispersing the toner as the toner moves between said holding portion and said dispensing portion as the toner cartridge is rotated, said holding portion tapering towards said inward curved projection.

2. The toner cartridge according to claim 1, further comprising a dispersing member freely moving within the toner cartridge for further dispersing the toner.

3. The toner cartridge according to claim 2 wherein said dispersing member is larger in size than said opening in said dispensing portion so as to prevent said dispersing member from exiting the toner cartridge.

4. The toner cartridge according to claim 1 wherein said holding portion has at least an arc so that a plurality of the toner cartridges is arranged to form a circular configuration.

5. The toner cartridge according to claim 4 wherein said plurality of the toner cartridges each contains yellow toner, cyan toner, magenta toner, and black toner.

6. The toner cartridge according to claim 1 wherein said dispensing portion forms a substantially funnel-shaped structure towards said opening.

7. A toner cartridge for use in an image reproduction system wherein said toner cartridge includes a holding portion located at a top portion of the toner cartridge for storing toner and a dispensing portion located at a bottom portion of the toner cartridge for dispensing the toner through an opening, the improvement comprising:

a dispersing portion located between said holding portion and said dispensing portion having an inward curved projection for dispersing the toner as the toner moves between said holding portion and said dispensing portion as the toner cartridge is rotated, said holding portion tapering towards said inward curved protection; and a dispersing member positioned in the toner cartridge, said dispersing member freely moving within the toner cartridge for further dispersing the toner.

8. The toner cartridge according to claim 7 wherein the toner cartridge has a substantially wedge shape.

9. The toner cartridge according to claim 7 wherein a plurality of the toner cartridges forms a substantially doughnut shape.

10. The toner cartridge according to claim 7 wherein the toner moves toward said dispensing portion mainly due to gravity.

11. The toner cartridge according to claim 7, further comprising a contact surface located at an outer surface of the toner cartridge for squarely contacting said contact surface of another adjacent toner cartridge of the same type for providing structural support.

12. The toner cartridge according to claim 11 wherein said contact surface is provided at two or more locations on said outer surface.

13. A toner supply system for an image reproduction device, comprising:

a developing unit for developing an image using toner;

a toner cartridge mounted to the exterior of said developing unit, said toner cartridge comprising a holding portion located at one end of said toner cartridge for storing said toner, a dispensing portion located at the other end of said toner cartridge, said dispensing portion having an opening, wherein said toner is dispensed through said opening, and a dispersing portion located between said holding portion and said dispensing portion having an inward curved projection for dispersing said toner before dispensing as said toner moves between said dispensing portion and said holding portion, said holding portion tapering towards said inward curved projection; and a toner transportation mechanism in fluid communication with said opening of said dispensing portion for transporting toner passing through said opening to said developing unit.

14. The toner supply system according to claim 13 wherein said toner transportation mechanism has a guide for mounting said toner cartridge to said toner transportation mechanism.

15. The toner supply system according to claim 13 wherein said toner cartridge further comprises a slide shutter located adjacent to said opening, said slide shutter slides so as to open said opening.

16. The toner supply system according to claim 15 wherein said slide shutter slides back to close said opening.

17. The toner supply system according to claim 13 wherein said toner transportation mechanism further comprises a latch for latching said toner cartridge to said toner transportation mechanism.

18. The toner supply according to claim 13 wherein said dispensing portion substantially forms a funnel towards said opening.

19. A toner cartridge system for an image reproduction apparatus, comprising:

a rotary developing device including a plurality of independent developing units, each of said developing units developing a part of an image using a unique color toner, wherein said plurality of independent developing units is rotatably positioned one at a time for use at a developing position; and a toner supply cartridge connected to each of said independent developing unite for supplying said unique color toner, said toner supply cartridge having a dispersing portion having an inward curved projection inside said toner supply cartridge for dispersing said toner as said toner supply cartridge is simultaneously rotated with said independent developing unit around the same axis, said toner supply cartridge tapering towards said inward curved projection.

20. The toner cartridge system according to claim 19 wherein said toner supply cartridge further comprises a dispensing portion located at one end of said toner supply cartridge, said dispensing portion including an opening for dispensing said unique color toner, said opening being optimally positioned for dispensing said unique color toner at said developing position.

21. The toner cartridge system according to claim 20 wherein said opening being positioned at the bottom of said toner supply cartridge at said developing position so as to dispense said unique color toner through said opening due to gravity.

22. The toner cartridge system according to claim 19 wherein said toner supply cartridge further comprising a dispersing member located inside said toner supply cartridge and freely moving inside said toner supply cartridge for further dispersing said unique color toner.

23. The toner cartridge system according to claim 19 wherein said rotary developing device further comprising a vibration device for vibrating said rotary developing device and said toner supply cartridge as said toner supply cartridge is rotatably moved at predetermined positions.

24. The toner cartridge system according to claim 19 wherein a plurality of said toner supply cartridges is arranged to form a substantially doughnut shape.

25. The toner cartridge system according to claim 24 further comprising a cylindrical toner cartridge located in the center of said doughnut shape for containing black toner.

26. A toner cartridge system for image reproduction, comprising:

rotary developing means including a plurality of independent developing units, each of said independent developing units developing a part of an image using a unique color toner, wherein said plurality of said developing units is rotatably positioned one at a time at a developing position;

toner supply means located outside said rotary developing means for supplying said unique color toner, said toner supply means including a holding portion located at one end of said toner supply means for storing said toner, a dispensing portion located at the other end of said toner supply means, said dispensing portion having an opening, wherein said toner is dispensed through said opening, said opening being optimally positioned for dispensing at said developing position, and a dispersing portion located between said holding portion and said dispensing portion, said dispersing portion having an inward curved projection for effectively dispersing the toner as the toner moves between said dispensing portion and said holding portion as the toner cartridge is rotated, said holding portion tapering towards said inward curved projection; and toner transportation means in fluid communication with said opening for transporting the toner from said opening to said independent developing unit.

* * * * *